US006403873B1

(12) United States Patent
Amaral et al.

(10) Patent No.: US 6,403,873 B1
(45) Date of Patent: Jun. 11, 2002

(54) TORPEDO JOINT BAND WITH IN-WATER SEPARATION CAPABILITY UTILIZING FRANGIBLE LINK EEDS

(75) Inventors: Antonio M. Amaral, East Providence; Robert F. Doleski, Middletown; Stephen F. Oliver, Portsmouth; Stanley J. Olson, Newport, all of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 32 days.

(21) Appl. No.: 09/648,530

(22) Filed: Aug. 22, 2000

(51) Int. Cl.[7] ..... F42B 19/00
(52) U.S. Cl. ..... 114/22; 102/378; 89/1.14
(58) Field of Search ..... 114/22; 102/378; 89/1.14

(56) References Cited

U.S. PATENT DOCUMENTS 3,458,217 A * 7/1969 Pride et al. ..... 285/3
3,636,877 A * 1/1972 Eaton ..... 102/49.5
3,716,010 A * 2/1973 Wilson et al. ..... 114/22
3,867,893 A * 2/1975 Saholt et al. ..... 114/20
3,903,803 A * 9/1975 Losey ..... 102/49.5
4,120,519 A * 10/1978 Bridges ..... 285/3
4,627,355 A * 12/1986 Gause et al. ..... 102/378
4,699,062 A * 10/1987 Lewis et al. ..... 102/378
4,719,858 A * 1/1988 Stiles ..... 102/378
5,671,650 A * 9/1997 Aubret ..... 89/1.14
6,227,493 B1 * 5/2001 Holemans ..... 244/158

* cited by examiner

*Primary Examiner*—Michael J. Carone
*Assistant Examiner*—M. Thomson
(74) *Attorney, Agent, or Firm*—Michael J. McGowen; James M. Kasischke; Prithvi C. Lall

(57) ABSTRACT

A joint band assembly secures payload and drive sections of a torpedo together and subsequently separates them while the torpedo is making a run. A pair of essentially semicircular bands is arranged in a ring shape have radially inwardly extending lip portions that compressively engage circumferential rims radially outwardly extending from a separation section having first and second parts connected to the payload and drive sections. Adjacent ends of the semicircular bands are coupled together by electro-explosive devices (EEDs) that each has a tubular body portion containing an explosive charge adjacent an annular segment of the tubular body portion. The annular segment has reduced thickness as compared to thickness of the tubular body portion to assure its rupture and separation of the body portion and the interconnected bands. The serial arrangement of bands and EEDs assures separation in the event that one of the electro-explosive devices should fail to detonate, and safety wire and a bonding agent hold separated parts together after detonation to prevent scattering of fragments and possible damage to the payload or drive sections.

12 Claims, 4 Drawing Sheets

TORPEDO JOINT BAND WITH IN-WATER SEPARATION CAPABILITY UTILIZING FRANGIBLE LINK EEDS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to undersea vehicles. More particularly, this invention relates to a joint band assembly for securing and subsequently releasing a payload section from a driving section of a torpedo.

(2) Description of the Prior Art

Torpedoes and other undersea vehicles place various payloads at or near a distant target, and typically, torpedoes have a forward or payload section mounted on a propulsion, or drive section that may also contain guidance systems. Some tactical situations may require that the payload section separate from the drive section somewhere along the path of the torpedo's run, and the drive section continues onward to another area.

Current devices for separating these sections, particularly during a run, have not been fully effective. Some of the separation devices include so many components that reliability is compromised. Others have such amounts of explosive as to create hazards for personnel that handle them onboard prior to launch, and when some are detonated during deployment, parts of the devices, fragments and concussion may damage the payload and drive sections to prevent their proper operation.

Thus, in accordance with this inventive concept, a need has been recognized for a cost-effective, reliable joint band assembly for securing a payload section to a drive section of a torpedo and subsequently releasing the payload section from the drive section with fewer fragments, lower concussion, limited explosive byproducts, and lower associated hazards.

SUMMARY OF THE INVENTION

A first object of the invention is to provide an apparatus for securing and subsequently releasing a payload section from a drive section of an undersea vehicle.

Another object of the invention is to provide a joint band assembly for securing and subsequently releasing a payload section from a drive section while a torpedo is making a run.

Another object of the invention is to provide an assembly that reduces risk of damaging torpedo sections during separation of sections.

Another object of the invention is to provide an assembly having serially coupled electro-explosive devices that assure fail safe operation if one device fails during separation of sections.

Another object of the invention is to provide an assembly having a pair of serially coupled electro-explosive devices that reduce creation of metal fragments and explosive by-products during detonation.

Another object of the invention is to provide an assembly having a pair of nonfragmenting semicircular links to reduce hazards to propellers or control surfaces of a torpedo's drive section.

Another object of the invention is to provide an assembly having serially coupled electro-explosive devices containing explosive therein to reduce hazards from rapidly escaping gas created during detonation.

An object of the invention is to provide a cost effective joint band assembly for securing and subsequently releasing a payload section from a drive section of a torpedo that is lightweight, strong, and able to withstand the effects of corrosive marine environments.

The present invention provides a joint band assembly for securing and subsequently releasing a payload section from a drive section of a torpedo. A pair of essentially semicircular bands is arranged in a ring shape with adjacent ends being separated from each other. Each band has a pair of parallel lip portions inwardly extending to engage radially outwardly extending annular rims of two parts of a separation section that are respectively connected to the payload section and the drive section. The bands are coupled together at both of their adjacent ends by a separate electro-explosive device connected between the adjacent ends. Each device has a tubular body portion containing an explosive charge adjacent to an annular undercut segment of the tubular body portion. The annular segment has reduced thickness as compared to thickness of the tubular body portion to rupture when the explosive charge is detonated.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENTS

Figure 1:
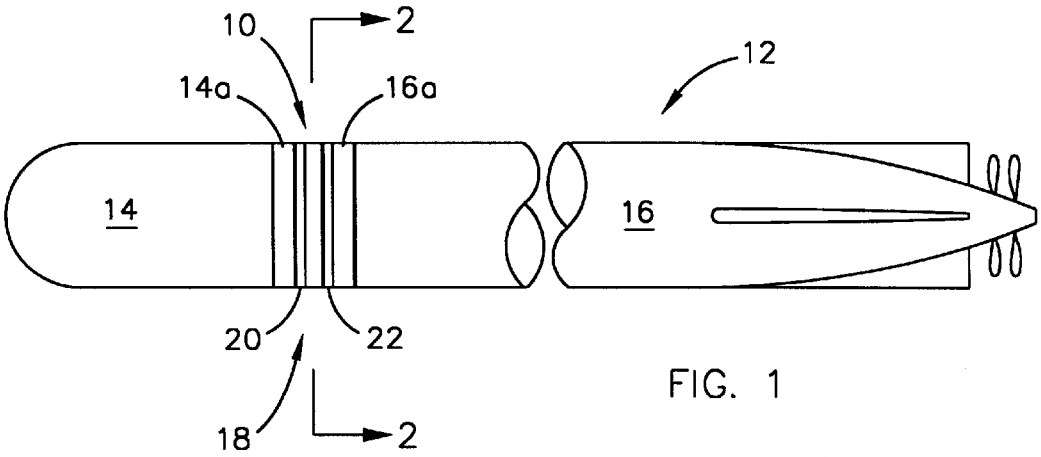
FIG. 1 schematically shows the joint band assembly of this invention securing adjacent portions of a separation section that are respectively connected to payload and drive sections of a torpedo.
Figure 3:
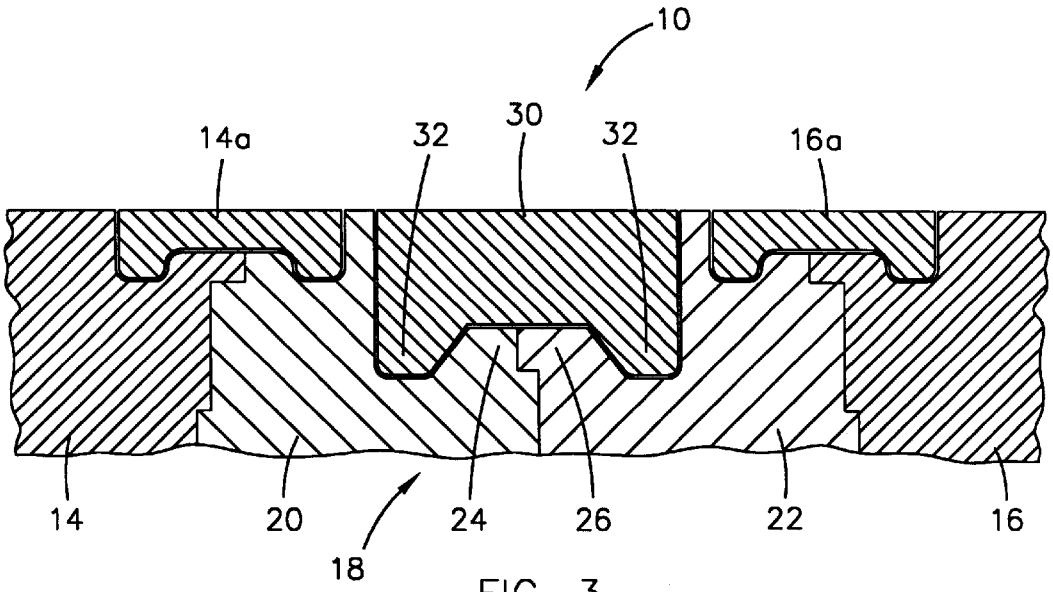
FIG. 3 is a cross-sectional view of a semicircular band taken along line 3—3 in FIG. 2.
Figure 2:
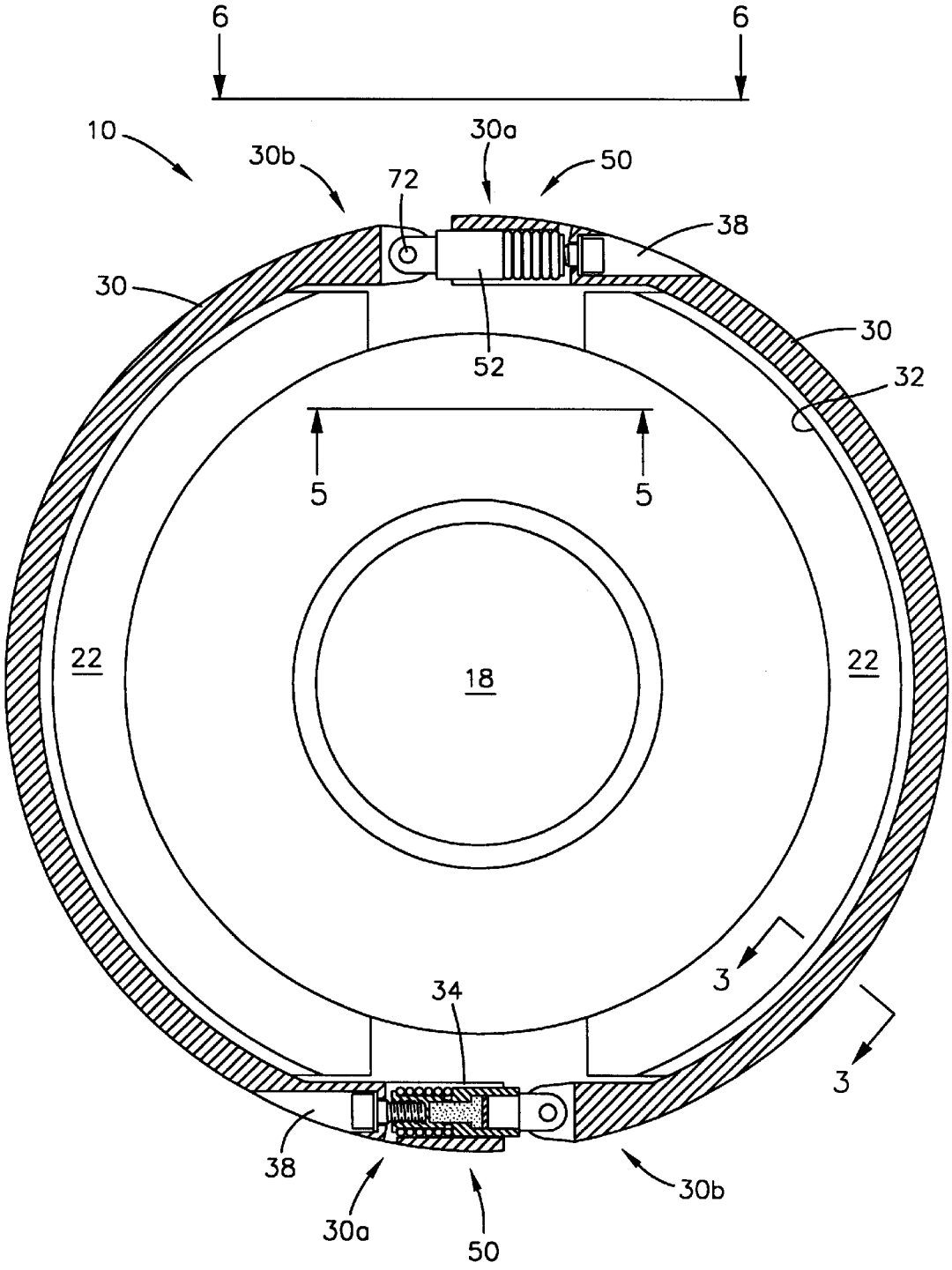
FIG. 2 is a cross-sectional side view of joint band assembly generally taken along line 2—2 in FIG. 1.

Referring to FIGS. 1, 2, and 3, joint band assembly 10 of this invention has found specific application in torpedo 12 to secure payload section 14 to drive section 16. Payload section 14 can be various types of ordnance such as a mine or a sensor package that is to be transported to a remote location and released from drive section 16 while it continues on its run. Drive section 16 may also carry another ordnance or sensor package and has the necessary guidance and propulsion systems including control surfaces and counter rotating propellers or pump-jet propulsor at its aft end.

Torpedo 12 includes separation section 18 interposed between payload section 14 and drive section 16. Payload section 14 and drive section 16 are sealed by watertight bulkheads, and the intermediate region between bulkheads is flooded. Separation section 18 may be made from high strength aluminum alloy and has a first part 20 connected to payload section 14 and a second part 22 connected to drive section 16. First and second parts 20 and 22 have circumferential rims 24 and 26, respectively, that contiguously abut when parts 20 and 22 are axially aligned and brought next to each other. Payload and drive sections 14 and 16 are connected to parts 20 and 22 by standard torpedo metal joint bands 14*a* and 16*a*. Bands 14*a* and 16*a* cover adjacent peripheral strips of the parts and sections and have attached bolts, washers and threaded inserts tightened to connect parts 20 and 22 of separation section 18 and sections 14 and 16 together.

Joint band assembly 10 of this invention thusly engages abutting circumferential rims 24 and 26 to secure payload section 14 to drive section 16 via separation section 18. However, joint band assembly 10 of this invention also is capable of separating payload section 14 from drive section 16 while torpedo 12 is making a run in water.

Joint band assembly 10 includes two essentially semicircularly-shaped bands 30 serially connected in a ring shape by two electro-explosive devices (EEDS) 50 that function as frangible links. Semicircularly-shaped bands 30 are virtually identical, and EEDs 50 are virtually identical to secure payload and drive sections 14 and 16 together, and reliably release these sections without creating fragments that might hinder their subsequent performance.

Figure 4:
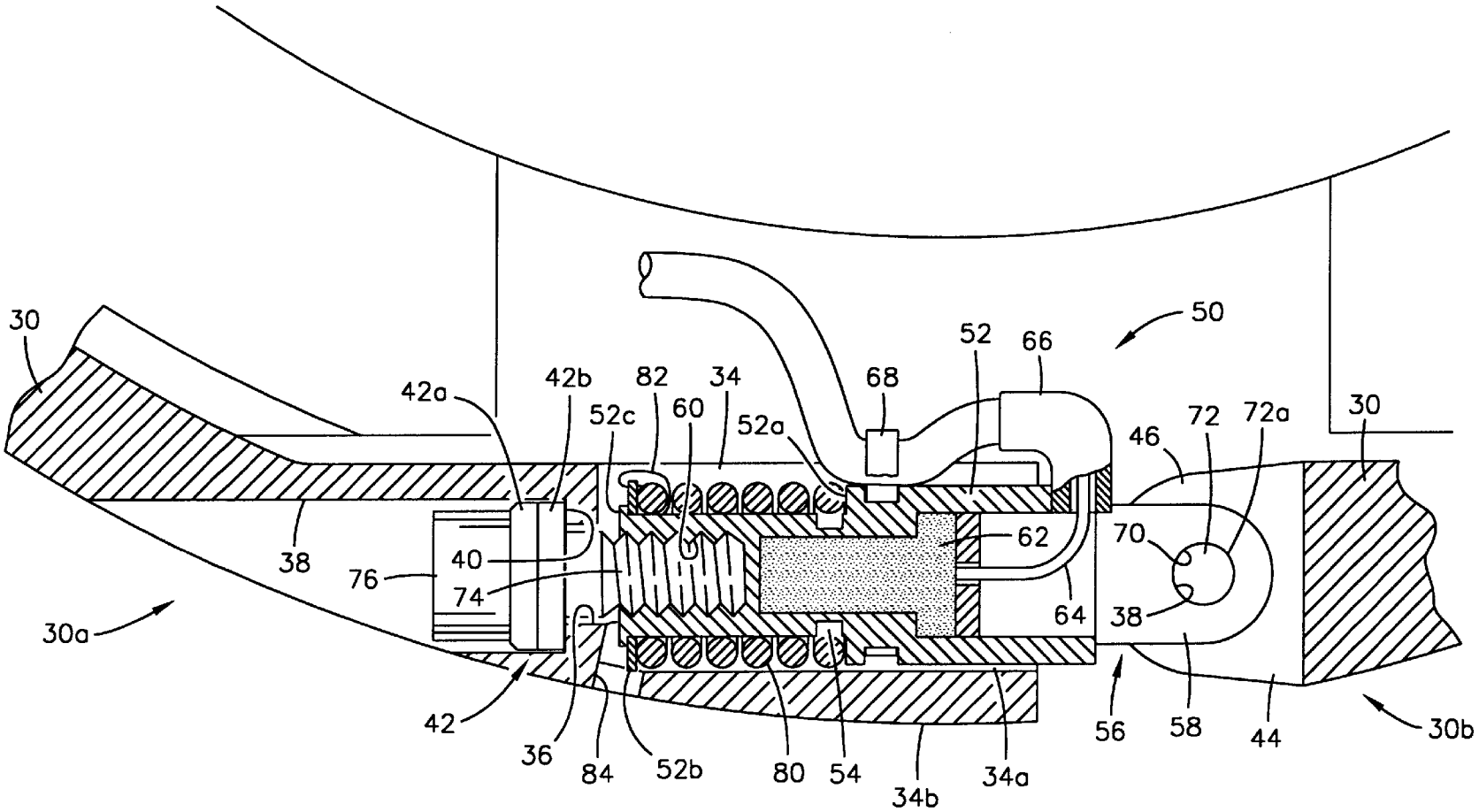
FIG. 4 is an enlarged cross-sectional side view of an electro-explosive device (EED) and bands taken along line 2—2 in FIG. 1.
Figure 5:
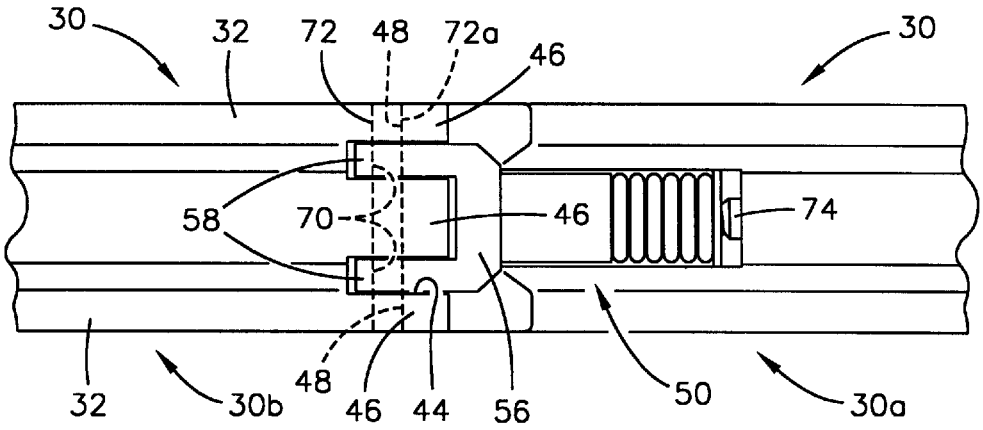
FIG. 5 is a bottom view from inside the joint band assembly of an EED along line 5—5 in FIG. 2.
Figure 6:
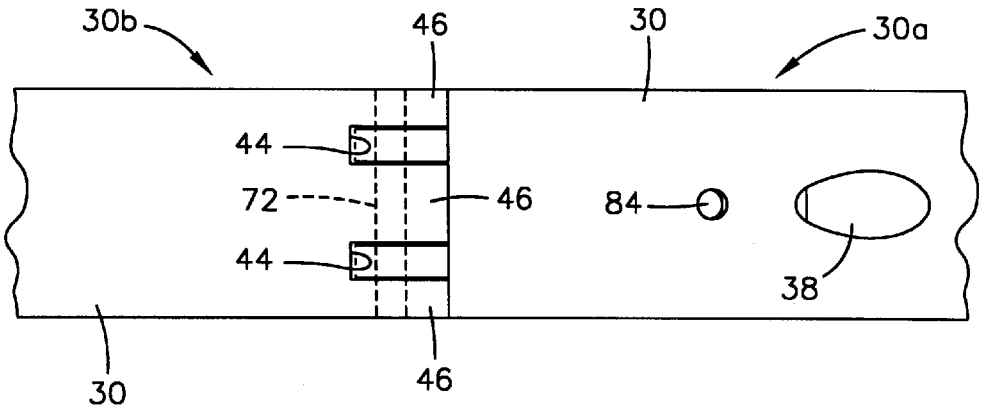
FIG. 6 is a top view from outside the joint band assembly of an EED along line 6—6 in FIG. 2.

Referring also to FIGS. 4, 5, and 6, each band 30 has lip portions 32 on opposite sides that inwardly extend to engage tapered circumferential rims 24 and 26 of first and second parts 20 and 22 of separation section 18. Bands 30 may be fabricated from high strength aluminum alloy to exert a substantial compressive force radially inwardly on circumferential rims 24 and 26 when these bands are displaced as explained below. This compressive force on circumferential rims 24 and 26 is of such magnitude to hold them axially against each other and, consequently, secure payload and drive sections 14 and 16 together. Pocket 34 is machined in one end 30*a* of band 30, and smooth bore 36 extends from pocket 34 to coaxially aligned larger bore, or rounded recess 38. Other end 30*b* of band 30 has slots 44 machined in it between end portions 46 that are provided with aligned parts of traverse bore 48.

Each EED 50 may be made from stainless steel or other strong and corrosion resistant material and is sized to fit within pocket 34 and keep space 34*a* between it and part 34*b* of band 30 next to pocket 34. EED 50 has tubular body portion 52 provided with annular segment 54 of reduced thickness that acts as a separation line next to shoulder 52*a*. A shackle portion 56 is provided at one end and a threaded bore 60 is provided at the other end. Explosive charge cutter 62 is fitted into tubular body portion 52 adjacent annular segment 54, and electrical lead 64 extends through feeder block 66 and under wire tie 68 to drive section 16. Wire tie 68 holds all parts of electrical leads 64 and feeder block 66 on tubular body portion 52 before explosive charge 62 is detonated to avoid damage to leads during assembly and weapon handling. Fragments are eliminated in the self-contained EED avoiding possible damage to the payload and drive sections 14 and 16.

Shackle portion 56 has two arms 58 provided with aligned parts of a lateral bore 70 to receive stainless steel pin 72. Use of two arms 58 minimizes stress on pin 72. Arms 58 fit into slots 44 in band 30 to align parts of traverse bore 48 (that is the same diameter as lateral bore 70) in end portions 46 of band 30 with lateral bore 70. Pin 72 extends through aligned parts of lateral bore 70 and aligned parts of traverse bore 48 to connect this end of EED 50 to band 30. Bonding agent 72*a* is applied to pin 72 and at least some aligned parts of traverse bore 48 to retain the pin 72 in the band 30 and permit free rotation of the EED shackle 56 about the pin 72.

When explosive charge cutter 62 is detonated rupturing annular segment 54 and separating tubular body portion 52, bonding agent 72*a* (after being cured) assures that pin 72, shackle portion 56, and the part of tubular body portion 52 that is attached to shackle portion 56 are retained on band 30. This reduces the possibility of damage to payload and drive sections 14 and 16.

Threaded bore 60 at the other end of EED 50 is sized and threaded to mate with threaded bolt 74 that slidably extends through smooth bore 36 in band 30. Larger bore 38 in band 30 defines an annular bearing surface 40 about the mouth of smooth bore 36 in band 30 for head 76 of bolt 74.

A spherical washer set 42 is provided adjacent annular bearing surface 40 and receives bolt 74. Spherical washer set 42 has convex portion 42*a* that contacts head 76 as bolt 74 is tightened and concave portion 42*b* adjacent bearing surface 40. The hole through portion 42*b* is larger than the hole through portion 42*a* so that portion 42*a* is free to rotate and be displaced relative to portion 42*b*. This relative rotational displacement prevents transfer of possibly destructive torsional or other uneven bending forces from head 76 to band 30 that may otherwise over stress the annular segment 54 and induce premature EED separation. Threaded bolt 74 can be rotated by an appropriate mating tool to engage threaded bore 60 and draw bands 30 toward each other to increase the compressive force exerted by lip portions 34 on rims 24 and 26 and preload annular segment 54.

Semicircular bands 30 optionally can have a retaining aperture formed therein for mounting a lanyard. Lanyard joins bands 30 with payload section 14 or drive section 16 for keeping bands 30 and associated parts away from propellers and control surfaces of torpedo 12.

Compressed steel or stainless steel spring 80 is retained on tubular body portion 52 between shoulder 52*a* at one end and stainless steel retaining ring 52*b* on shoulder 52*c*. Retaining ring 52*b* may be a high strength snap-ring type that securely engages an outer surface tubular body portion 52 and/or shoulder 52*c*. Retaining ring 52*b* may be used by itself to hold its end of spring 80 on tubular body portion 52 or may be used in conjunction with a washer to help bear the biasing force, or urging of spring 80. Spring 80 spans the width of the separation line of annular segment 54 that is adjacent shoulder 52*a*. Spring 80 creates an additional force of about 100 pounds to help separate EED 50 when explosive charge 62 is detonated and separates, or ruptures tubular body portion 52 along rupturable annular segment 54.

A safety wire 82 is tied to spring 80 and under one of the two local gaps in the bore of retaining ring 52*b* to avoid scattering of these parts and other debris and ensure that they remain with band 30 after detonation of explosive charge 62 and separation of tubular body portion 54. The possibility of damage to payload and drive sections 14, 16 is thus reduced. Inspection port 84 in band 30 permits observation and checking of clearance between band 30 and the outside surface of retaining ring 52*b* or tubular body portion 52 of EED 50. Such checking assures that EED 50 does not contact band 30 to such an extent that it becomes twisted, possibly jammed and/or breaks part 34*b* of band 30 after threaded bolt 74 is tightened.

The tensile load at one end of EED 50 is transferred from one end 30*a* of one band 30 through bolt 74 and distributed to spherical washer set 42 on annular bearing surface 40 to minimize bending moments on the separation zone of EED 50 adjacent annular segment 54. The tensile load on the other end of EED 50 is transferred from the other end 30*b* of the other band 30, through end portions 46, through pin 72, and to two arms 58 of shackle portion 56. These loads are equally shared by arms 58 of the EED attached with bolt 74 to bearing surface 40 on one band 30 and end portions 46 in the other band 30, so the possibility of jamming and over stressing is reduced.

Joint band assembly 10 provides a series arrangement of EEDs 50 and bands 30 to assure fail-safe operation if either EED 50 fails to detonate or otherwise not separate. Only two bands 30 are needed to span the circumference of torpedo 12 as compared to contemporary systems that have more band segment structures. Thus, pin 72 on a possibly failed EED 50 is able to pivot to open assembly 10 when the other EED 50 on the other side is initiated and thereby permit payload section 14 and drive section 16 to separate successfully.

Other than the insignificant amount of material that might possibly be created during rupturing of annular segment 54 of EED 50, EED 50 is essentially nonfragmenting. Since explosive charge 62 is contained in EED 50, rapidly escaping gas and noise are greatly reduced as compared to existing bolt cutter joint band systems using a four-segment joint band.

EEDs 50 are smaller and lighter than the explosive devices of the existing system and are potentially less expensive. Accordingly, bands 30 are not damaged by detonation so they can be retrieved and reused. EEDs 50 are coupled to larger and stronger bands 30 than those used in the existing system but do not require extra space between payload section 14 and drive section 16. Only two EEDs 50 secure bands 30 as compared to eight bolts used in the existing system. EEDs 50 and bands 30 of this invention have at least the same structural integrity of standard joint rings and do not create fragments or other debris that might damage payload section 14 or the rest of torpedo 12.

Because of the reliable design of joint band assembly 10, EEDs 50 and pins 72 may be made from stainless steel so that assembled EEDs 50 may be stored in flooded torpedo tubes with minimal corrosion potential. This feature further distinguishes from the existing system that is plated steel and was intended to be stored in air prior to being deployed in seawater.

Having the teachings of this invention in mind, modifications and alternate embodiments of this invention may be fabricated. For examples, in accordance with this invention, joint band assemblies 10 could be fabricated from alternative materials, such as various aluminum and stainless steel alloys, composites, plating, welding, and coatings. These materials could be incorporated in joint band assembly 10 to minimize the thickness of bands 30 yet provide sufficient local end thickness to attach EEDs 50. Designs could be modified to expedite mass production and further reduce costs even for more unique designs and specialized machining or multiple part band assemblies.

The disclosed components and their arrangements as disclosed herein all contribute to the novel features of this invention. This invention provides a reliable and cost-effective joint band assembly 10. Therefore, joint band assembly 10, as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A joint band assembly comprising:

a pair of essentially semicircular bands arranged in a ring shape with adjacent ends being separated from each other, each band having a pair of parallel lip portions inwardly radially extending therefrom; and a pair of electro-explosive devices each being connected between said adjacent ends of said bands, each of said devices having a tubular body portion containing an explosive charge adjacent an annular segment of said tubular body portion, said annular segment having reduced wall thickness as compared to the wall thickness of said tubular body portion;

wherein said annular segment is rupturable by detonation of said explosive charge separating said tubular body portion and further separating said semicircular bands, said explosive charge being capable of detonation by a signal fed to said explosive charge over an interconnected lead;

each said electro-explosive device further comprising:

a shoulder positioned at one end of said tubular body portion;

a retaining ring positioned at the other end of said tubular body portion;

a spring compressed between said shoulder and said retaining ring on said tubular body portion, said spring extending across said annular segment to urge separation of said body portion; and a shackle connected to one end of said tubular body portion having arms provided with aligned parts of a lateral bore extending therethrough, said tubular body portion having a threaded bore at its other end.

2. An assembly according to claim 1 wherein each said semicircular band further comprises a pocket having a smooth bore and rounded recess extending therefrom formed in one end of each semicircular band; and a slotted end portion having aligned parts of a traverse bore being the same diameter as said lateral bore in an opposite end of each semicircular band.

3. An assembly according to claim 2 wherein each said electro-explosive device further comprises:

a threaded bolt extending through said rounded recess having a head to bear against an annular bearing surface at the mouth of said smooth bore, said threaded bolt engaging said threaded bore of said tubular body portion and connecting said other end of said tubular body portion to said one end of each semicircular band; and a pin extending through said aligned parts of said lateral bore in said shackle and said aligned parts of said traverse bore in said slotted end portion to connect said one end of said tubular body portion to said opposite end of each semicircular band.

4. An assembly according to claim 3 wherein each said electro-explosive device further comprises a spherical washer set interposed between said head of said threaded bolt and said annular bearing surface to prevent transfer of torsional forces and bending moments to said semicircular band.

5. An assembly according to claim 4 wherein each said electro-explosive device further comprises a first wire tie wrapped about said retaining ring and said spring to hold said spring on a part of said tubular body portion engaged by said threaded bolt, upon detonation of said explosive charge to rupture said annular segment, said first wire tie retaining said ring and spring with said threaded bolt in said semicircular band.

6. An assembly according to claim 5 wherein each said electro-explosive device further comprises a bonding agent applied to said pin and said aligned parts of said traverse bore to assure retention of said pin, said shackle, and part of said tubular body portion attached to said shackle, upon detonation of said explosive charge to rupture said annular segment, said bonding agent avoiding scattering said pin, said shackle, and part of said tubular body portion attached to said shackle.

7. An apparatus for securing and subsequently releasing a payload section from a drive section of a torpedo comprising:

a separation section having a first part connected to a payload section and a second part connected to a drive section of a torpedo, said first and second parts each having a circumferential rim radially extending therefrom and disposed to abut each other;

a pair of essentially semicircular bands arranged in a ring shape around said separation section with adjacent ends being separated from each other, said bands each have a pair of parallel lip portions inwardly radially extending therefrom, one lip portion engaging said circumferential rim on said first part and said other lip portion engaging said circumferential rim on said second part; and a pair of electro-explosive devices each being connected between said adjacent ends of said bands on the exterior of said separation section, each of said electro-explosive devices having a tubular body portion containing an explosive charge adjacent an annular segment of said tubular body portion, said annular segment having reduced wall thickness as compared to the wall thickness of said tubular body portion;

wherein said annular segment is rupturable by detonation of said explosive charge separating said tubular body portion, said semicircular bands, and said payload and drive sections, said explosive charge being capable of detonation by a signal fed to said explosive charge over an interconnected lead;

each said electro-explosive device further comprising:

a shoulder positioned at one end of said tubular body portion;

a retaining ring positioned at the other end of said tubular body portion;

a spring compressed between said shoulder and said retaining ring on said tubular body portion, said spring extending across said annular segment to urge separation of said body portion; and a shackle connected to one end of said tubular body portion having arms provided with aligned parts of a lateral bore extending therethrough, said tubular body portion having a threaded bore at its other end.

8. An apparatus according to claim 7 wherein each said semicircular band further comprises:

a pocket having a smooth bore and rounded recess extending therefrom formed in one end of each semicircular band; and a slotted end portion having aligned parts of a traverse bore being the same diameter as said lateral bore in an opposite end of each semicircular band.

9. An apparatus according to claim 8 wherein each said electro-explosive device further comprises:

a threaded bolt extending through said rounded recess having a head to bear against an annular bearing surface at the mouth of said smooth bore, said threaded bolt engaging said threaded bore of said tubular body portion and connecting said other end of said tubular body portion to said one end of each semicircular band; and a pin extending through said aligned parts of said lateral bore in said shackle and said aligned parts of said traverse bore in said slotted end portion to connect said one end of said tubular body portion to said opposite end of each semicircular band.

10. An apparatus according to claim 9 wherein each said electro-explosive device further comprises a spherical washer set interposed between said head of said threaded bolt and said annular bearing surface to prevent transfer of torsional forces and bending moments.

11. An apparatus according to claim 10 wherein each said electro-explosive device further comprises a first wire tie wrapped about said retaining ring and said spring to hold said spring on a part of said tubular body portion engaged by said threaded bolt, upon detonation of said explosive charge to rupture said annular segment, said first wire tie retaining said ring and spring and with said threaded bolt in said semicircular band.

12. An apparatus according to claim 11 wherein each said electro-explosive device further comprises a bonding agent applied to said pin and said aligned parts of said traverse bore to assure retention of said pin, said shackle, and part of said tubular body portion attached to said shackle, upon detonation of said explosive charge to rupture said annular segment, said bonding agent avoiding scattering said pin, said shackle, and part of said tubular body portion attached to said shackle.

* * * * *